US007534064B2

(12) United States Patent
Cheng

(10) Patent No.: US 7,534,064 B2
(45) Date of Patent: May 19, 2009

(54) RING MECHANISM BIASED TO CLOSED AND LOCKED POSITION

(75) Inventor: Hung Yu Cheng, Hong Kong (CN)

(73) Assignee: World Wide Stationery Mfg. Co., Ltd., Kwai Chung, New Territory (HK)

( * ) Notice: Subject to any disclaimer, the term of this patent is extended or adjusted under 35 U.S.C. 154(b) by 301 days.

(21) Appl. No.: 10/905,606

(22) Filed: Jan. 12, 2005

(65) Prior Publication Data

US 2006/0153629 A1 Jul. 13, 2006

(51) Int. Cl.

| | |
|---|---|
| ***B42F 3/02*** | (2006.01) |
| ***B42F 13/02*** | (2006.01) |
| ***B42F 3/04*** | (2006.01) |
| ***B42F 3/00*** | (2006.01) |
| ***B42F 13/12*** | (2006.01) |

(52) U.S. Cl. ..... 402/19; 402/35; 402/41; 402/70

(58) Field of Classification Search ..... 402/19, 402/20, 23, 26, 31, 35–39, 41, 42, 70, 73, 402/76, 77; 267/109

See application file for complete search history.

(56) References Cited

U.S. PATENT DOCUMENTS

| | | | |
|---|---|---|---|
| 566,717 | A | 8/1896 | Krah |
| 651,254 | A | 6/1900 | Krah |
| 683,019 | A | 9/1901 | Buchanan |
| 857,377 | A | 6/1907 | Baker |
| 974,831 | A | 11/1910 | Scherzinger |
| 1,011,391 | A | 12/1911 | Sturgis |
| 1,163,179 | A | 12/1915 | Schade, Jr. |
| 1,168,260 | A | 1/1916 | Albrecht |
| 1,398,034 | A | 11/1921 | Mero |
| 1,398,388 | A | 11/1921 | Murphy |
| 1,733,548 | A | 10/1929 | Martin |

(Continued)

FOREIGN PATENT DOCUMENTS

| | | | |
|---|---|---|---|
| DE | 10119121 | A1 | 10/2001 |

(Continued)

OTHER PUBLICATIONS

Kokuyo Lock Ring Mechanism with description, two instruction sheets, and nine photographs, undated but admitted as prior art, 12 pgs.

(Continued)

*Primary Examiner*—Dana Ross
*Assistant Examiner*—Kyle Grabowski
(74) *Attorney, Agent, or Firm*—Senniger Powers LLP

(57) ABSTRACT

A ring binder mechanism that retains loose-leaf pages and has ring members that readily lock together in a closed position, preventing accidental opening of the ring members and loss of pages. The mechanism comprises a housing that supports two hinge plates for pivoting motion that brings the ring members to either an open position or the closed position. The mechanism further comprises a control structure supported by the housing for causing the pivoting motion of the hinge plates. A spring plate is engageable with the control structure for urging the control structure to move toward a position blocking pivoting motion of the hinge plates when the ring members move to the closed position.

13 Claims, 8 Drawing Sheets

U.S. PATENT DOCUMENTS

| | | | | |
|---|---|---|---|---|
| 1,733,894 | A | 10/1929 | Martin | |
| 1,787,957 | A | 1/1931 | Schade | |
| 1,822,669 | A | 9/1931 | Schade | |
| 1,857,291 | A | 5/1932 | Trussell | |
| 1,991,362 | A | 2/1935 | Krag | |
| 1,996,463 | A | 4/1935 | Dawson et al. | |
| 2,004,570 | A | 6/1935 | Dawson | |
| 2,013,416 | A | 9/1935 | McClure | |
| 2,024,461 | A | 12/1935 | Lotter | |
| 2,067,846 | A | 1/1937 | Cooper | |
| 2,075,766 | A | 3/1937 | Rand | |
| 2,089,211 | A | 8/1937 | Krag | |
| 2,096,944 | A | 10/1937 | Unger et al. | |
| 2,103,307 | A | 12/1937 | Unger | |
| 2,158,056 | A | 5/1939 | Cruzan | |
| 2,179,627 | A | 11/1939 | Handler | |
| 2,204,918 | A | 6/1940 | Trussell | |
| 2,218,105 | A | 10/1940 | Griffin | |
| 2,236,321 | A | 3/1941 | Ostrander | |
| 2,239,062 | A * | 4/1941 | Tallmadge | 5/247 |
| 2,239,121 | A | 4/1941 | St. Louis et al. | |
| 2,251,878 | A | 8/1941 | Hanna | |
| 2,252,422 | A | 8/1941 | Unger | |
| 2,260,929 | A | 10/1941 | Bloore | |
| 2,288,189 | A | 6/1942 | Guinane | |
| 2,304,716 | A | 12/1942 | Supin | |
| 2,311,492 | A | 2/1943 | Unger | |
| 2,322,595 | A | 6/1943 | Schade | |
| 2,421,799 | A | 6/1947 | Martin | |
| 2,528,866 | A | 11/1950 | Dawson, Jr. | |
| 2,543,866 | A | 3/1951 | Panfil | |
| 2,552,076 | A | 5/1951 | Wedge | |
| 2,612,169 | A | 9/1952 | Segal | |
| 2,789,561 | A | 4/1957 | Bonn | |
| 2,865,377 | A | 12/1958 | Schroer et al. | |
| 2,871,711 | A | 2/1959 | Stark | |
| 2,891,553 | A | 6/1959 | Acton | |
| 2,894,513 | A | 7/1959 | Gempe | |
| 3,077,888 | A | 2/1963 | Thieme | |
| 3,098,489 | A | 7/1963 | Vernon | |
| 3,098,490 | A | 7/1963 | Wance | |
| 3,190,293 | A | 6/1965 | Schneider et al. | |
| 3,205,894 | A | 9/1965 | Rankin | |
| 3,205,895 | A | 9/1965 | Johnson | |
| 3,255,759 | A | 6/1966 | Dennis | |
| 3,348,550 | A | 10/1967 | Wolf et al. | |
| 3,718,402 | A | 2/1973 | Schade | |
| 3,748,051 | A | 7/1973 | Frank | |
| 3,884,586 | A | 5/1975 | Michaelis et al. | |
| 3,954,343 | A | 5/1976 | Thomsen | |
| 3,993,374 | A | 11/1976 | Schudy et al. | |
| 4,127,340 | A | 11/1978 | Almgren | |
| 4,130,368 | A | 12/1978 | Jacoby et al. | |
| 4,352,582 | A | 10/1982 | Eliasson | |
| 4,486,112 | A | 12/1984 | Cummins | |
| 4,522,526 | A | 6/1985 | Lozfau | |
| 4,566,817 | A | 1/1986 | Barrett, Jr. | |
| 4,571,108 | A | 2/1986 | Vogl | |
| 4,696,595 | A | 9/1987 | Pinkney | |
| 4,798,491 | A | 1/1989 | Lässle | |
| 4,813,803 | A | 3/1989 | Gross | |
| 4,815,882 | A | 3/1989 | Ohminato | |
| 4,886,390 | A | 12/1989 | Silence | |
| 4,919,557 | A | 4/1990 | Podosek | |
| 5,116,157 | A | 5/1992 | Gillum et al. | |
| 5,180,247 | A | 1/1993 | Yu | |
| 5,255,991 | A | 10/1993 | Sparkes | |
| 5,286,128 | A | 2/1994 | Gillum | |
| 5,332,327 | A | 7/1994 | Gillum | |
| 5,346,325 | A | 9/1994 | Yamanoi | |
| 5,354,142 | A | 10/1994 | Yu | |
| 5,368,407 | A | 11/1994 | Law | |
| 5,378,073 | A | 1/1995 | Law | |
| 5,393,155 | A | 2/1995 | Ng | |
| 5,476,335 | A | 12/1995 | Whaley | |
| 5,524,997 | A | 6/1996 | von Rohrscheidt | |
| 5,577,852 | A | 11/1996 | To | |
| 5,651,628 | A | 7/1997 | Bankes | |
| 5,660,490 | A | 8/1997 | Warrington | |
| 5,692,847 | A | 12/1997 | Zane et al. | |
| 5,692,848 | A | 12/1997 | Wada | |
| 5,718,529 | A | 2/1998 | Chan | |
| 5,782,569 | A | 7/1998 | Mullin et al. | |
| 5,807,006 | A | 9/1998 | Cheung | |
| 5,810,499 | A | 9/1998 | Law | |
| 5,816,729 | A | 10/1998 | Whaley | |
| 5,836,709 | A | 11/1998 | Cheung | |
| 5,868,513 | A | 2/1999 | Law | |
| 5,879,097 | A | 3/1999 | Cheng | |
| 5,882,135 | A | 3/1999 | Ko | |
| 5,895,164 | A | 4/1999 | Wu | |
| 5,924,811 | A | 7/1999 | To | |
| 5,957,611 | A | 9/1999 | Whaley | |
| 5,975,785 | A | 11/1999 | Chan | |
| 6,036,394 | A | 3/2000 | Cheng | |
| 6,146,042 | A | 11/2000 | To | |
| 6,155,737 | A | 12/2000 | Whaley | |
| 6,206,601 | B1 | 3/2001 | Ko | |
| 6,217,247 | B1 | 4/2001 | Ng | |
| 6,270,279 | B1 | 8/2001 | Whaley | |
| 6,276,862 | B1 * | 8/2001 | Snyder et al. | 402/40 |
| 6,293,722 | B1 | 9/2001 | Holbrook et al. | |
| 6,364,558 | B1 | 4/2002 | To | |
| 6,371,678 | B1 | 4/2002 | Chizmar | |
| 6,467,984 | B1 * | 10/2002 | To | 402/38 |
| 6,474,897 | B1 | 11/2002 | To | |
| 6,533,486 | B1 | 3/2003 | To | |
| 6,749,357 | B2 * | 6/2004 | Cheng | 402/19 |
| 6,758,621 | B2 | 7/2004 | To | |
| 6,821,045 | B2 | 11/2004 | Whaley | |
| 6,840,695 | B2 | 1/2005 | Horn | |
| 6,916,134 | B2 * | 7/2005 | Wong | 402/26 |
| 7,296,946 | B2 | 11/2007 | Cheng | |
| 2003/0103797 | A1 | 6/2003 | Cheng | |
| 2003/0103798 | A1 * | 6/2003 | Cheng et al. | 402/73 |
| 2003/0123923 | A1 | 7/2003 | Koike et al. | |
| 2005/0013654 | A1 * | 1/2005 | Cheng et al. | 402/36 |
| 2005/0201817 | A1 | 9/2005 | Cheng | |
| 2005/0201818 | A1 | 9/2005 | Cheng | |
| 2005/0201819 | A1 | 9/2005 | Cheng | |
| 2005/0201820 | A1 | 9/2005 | Ng | |
| 2005/0207826 | A1 | 9/2005 | Cheng | |
| 2005/0214064 | A1 | 9/2005 | Ng | |
| 2005/0232689 | A1 | 10/2005 | Cheng | |
| 2006/0008318 | A1 | 1/2006 | Ng | |
| 2006/0056906 | A1 | 3/2006 | Horn | |
| 2006/0088365 | A1 * | 4/2006 | Whaley | 402/38 |
| 2006/0147253 | A1 | 7/2006 | Cheng | |
| 2006/0147254 | A1 | 7/2006 | Cheng | |
| 2006/0147255 | A1 | 7/2006 | Cheng | |
| 2006/0153628 | A1 | 7/2006 | Tanaka | |
| 2006/0153629 | A1 | 7/2006 | Cheng | |
| 2006/0216107 | A1 | 9/2006 | Lin | |
| 2006/0228164 | A1 | 10/2006 | Horn | |
| 2006/0251467 | A1 | 11/2006 | Cheng | |
| 2006/0251468 | A1 | 11/2006 | Cheng | |
| 2007/0086836 | A1 | 4/2007 | Cheng | |

FOREIGN PATENT DOCUMENTS

| | | |
|---|---|---|
| EP | 1316438 A1 | 4/2003 |
| EP | 1323545 A2 | 7/2003 |
| EP | 1431065 A2 | 6/2004 |
| FR | 1 336 765 | 7/1962 |

| | | | |
|---|---|---|---|
| FR | 1 346 864 | A | 12/1963 |
| FR | 2221924 | | 10/1974 |
| FR | 2 238 332 | A | 2/1975 |
| GB | 868724 | | 5/1961 |
| GB | 906279 | | 9/1962 |
| GB | 952536 | | 3/1964 |
| GB | 2231536 | A | 11/1990 |
| GB | 2251215 | A | 7/1992 |
| GB | 2275023 | A | 8/1994 |
| GB | 2292343 | A | 2/1996 |
| GB | 2387815 | A | 10/2003 |
| JP | 59-79379 | | 5/1984 |
| JP | 61-18880 | | 2/1986 |
| JP | 1299095 | A | 12/1989 |
| JP | 4-120085 | | 10/1992 |
| JP | 2004098417 | A | 4/2004 |
| WO | 0119620 | A1 | 3/2001 |
| WO | WO 01/19620 | A1 | 3/2001 |
| WO | 0181099 | A1 | 11/2001 |

OTHER PUBLICATIONS

Nov. 23, 2007 Office Action and references cited by Examiner in related U.S. Appl. No. 10/870,801, 36 pages.

* cited by examiner

RING MECHANISM BIASED TO CLOSED AND LOCKED POSITION

BACKGROUND OF THE INVENTION

This invention relates to a ring binder mechanism for retaining loose-leaf pages, and in particular to an improved mechanism for opening and closing ring members and for readily and securely locking closed ring members together.

As is known in the art, a typical ring binder mechanism retains loose-leaf pages, such as hole-punched pages, in a file or notebook. It has multiple rings each including two half ring members capable of selectively opening to add or remove pages, or selectively closing to retain pages and allow them to move along the ring members. The ring members mount on two adjacent hinge plates that join together about a pivot axis for pivoting movement within an elongated housing. The housing loosely holds the hinge plates so they may pivot relative to the housing. The undeformed housing is slightly narrower than the joined hinge plates when the hinge plates are in a coplanar position (180°). So as the hinge plates pivot through this position, they deform the resilient housing and cause a spring force in the housing urging the hinge plates to pivot away from the coplanar position, either opening or closing the ring members. Thus, when the ring members are closed, the spring force resists hinge plate movement and clamps the ring members together. Similarly, when the ring members are open, the spring force holds them apart. An operator may typically overcome this force by manually pulling the ring members apart or pushing them together. In addition, in some mechanisms the operator may move a lever located at one or both ends of the mechanism to move the hinge plates through the coplanar position.

One drawback to these typical ring binder mechanisms is that a substantial housing spring force is required to hold the closed ring members together. When the ring members close, the housing spring force snaps the ring members together rapidly and with a force that might cause fingers to be pinched between the ring members. In addition, the housing spring force makes pivoting the hinge plates through the coplanar position (180°) difficult such that it is hard to both open and close the ring members. Another drawback of typical ring binder mechanisms is that when the ring members are closed, they do not positively lock together. So if the mechanism is accidentally dropped, the ring members may unintentionally open. Still another drawback of typical mechanisms is that over time the housing may begin to permanently deform, reducing its ability to uniformly clamp the ring members together and possibly allowing gaps to form between closed ring members.

To address these concerns, some ring binder mechanisms include a control slide attached to a lever. These control slides have inclined cam surfaces that project through openings in the hinge plates for rigidly controlling the hinge plates' pivoting motion both when opening and closing the ring members. Examples of these types of mechanisms are shown in U.S. Pat. Nos. 4,566,817, 4,571,108, and 6,276,862 and in U.K. Pat. No. 2,292,343. In addition, some of the cam surfaces have stops for blocking the hinge plates' pivoting motion when the ring members are closed and for locking the closed ring members together. But the operator must manually move the lever to move the control slide stops into the blocking position to lock the ring members. Failure to do this could result in the rings inadvertently opening and pages falling out. Any solution to this issue should be made so as to keep the construction simple and economic, and avoid causing the rings to snap closed.

Accordingly, there is a need for an efficient ring binder mechanism that readily locks when ring members close for retaining loose-leaf pages and has ring members that easily open and close.

SUMMARY OF THE INVENTION

A ring binder mechanism for retaining loose-leaf pages generally comprises a housing supporting hinge plates for pivoting motion relative to the housing. The mechanism also includes rings for holding the loose-leaf pages. Each ring includes a first ring member and a second ring member. The first ring member is mounted on a first hinge plate and is moveable with the pivoting motion of the first hinge plate relative to the second ring member. The two ring members move between a closed position and an open position. In the closed position, the two ring members form a substantially continuous, closed loop for allowing loose-leaf pages retained by the rings to be moved along the rings from one ring member to the other. In the open position, the two ring members form a discontinuous, open loop for adding or removing loose-leaf pages from the rings. A control structure supported by the housing is moveable between a first position and a second position and causes the pivoting motion of the hinge plates. A spring plate operatively connected to the control structure urges it toward the first position.

In another aspect, the ring binder mechanism generally comprises an actuating lever mounted on the housing and a travel bar operatively connected to the lever and supported by the housing for translational movement relative to the housing. The travel bar includes a locking element moveable with the travel bar between a first position blocking pivoting motion of the hinge plates and a second position. A spring plate operatively connected to the travel bar and housing urges the travel bar to move the locking element toward the first position.

Other features of the invention will be in part apparent and in part pointed out hereinafter.

Corresponding reference characters indicate corresponding parts throughout the views of the drawings.

DETAILED DESCRIPTION OF THE INVENTION

Figure 1:
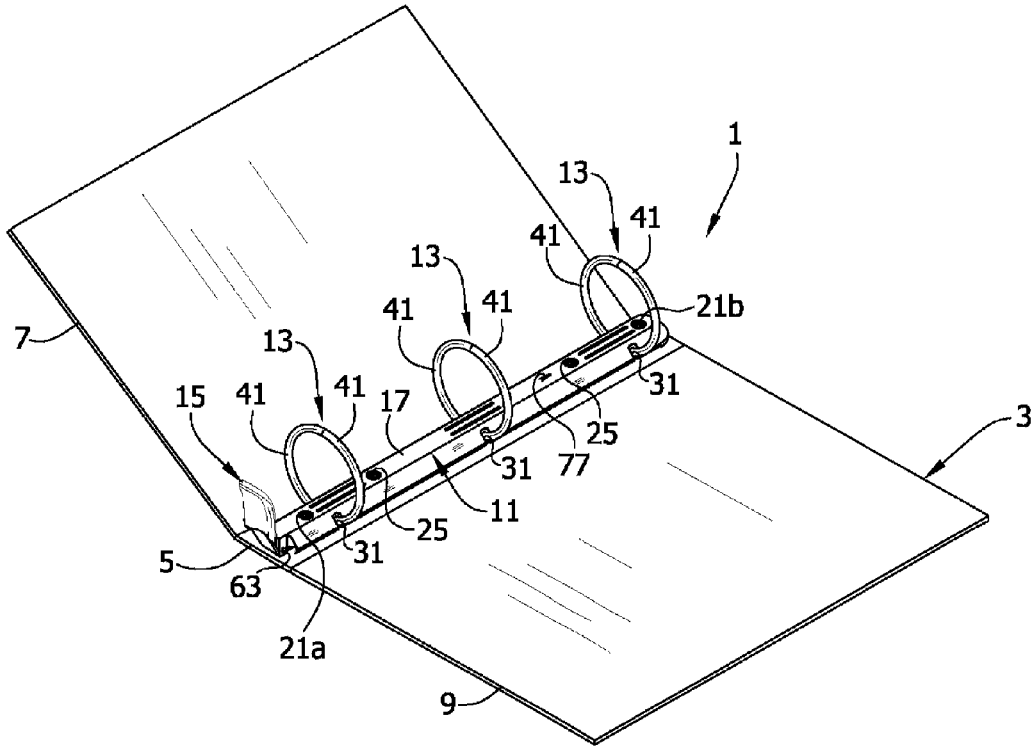
FIG. 1 is a perspective of a notebook incorporating a ring binder mechanism of the invention.

Referring now to the drawings, FIG. 1 shows a ring binder mechanism of the invention generally at reference numeral 1. The mechanism is shown mounted on a notebook, designated generally by reference numeral 3, and is capable of retaining loose-leaf pages (not shown) in the notebook. In particular, mechanism 1 is shown mounted on spine 5 of notebook 3 having front cover 7 and back cover 9 hingedly attached to the spine for moving to selectively cover or expose retained pages.

As can be seen, mechanism 1 includes a housing, designated generally by reference numeral 11, supporting three rings, each designated generally by reference numeral 13. Each ring includes two ring members, each designated by reference number 41, that will be described more hereinafter. A lever (broadly, "actuator"), designated generally by reference numeral 15, is shown pivotally mounted on one longitudinal end of housing 11 and can move ring members 41 of rings 13 between a closed position and an open position. Lever 15 is also moveable to lock the rings closed, as will be described in greater detail hereinafter. In illustrated mechanism 1, a second longitudinal end of housing 11 has no actuating lever. But it is to be understood that a mechanism having an actuating lever at both ends of a housing does not depart from the scope of the invention. Moreover, actuators other than levers (e.g., a push button) could be used within the scope of the invention. Further, a mechanism with a different number of rings, greater or fewer than three, does not depart from the scope of this invention. Still further, the ring mechanism of the invention may be used by itself with supporting structure other than a notebook.

Figure 2:
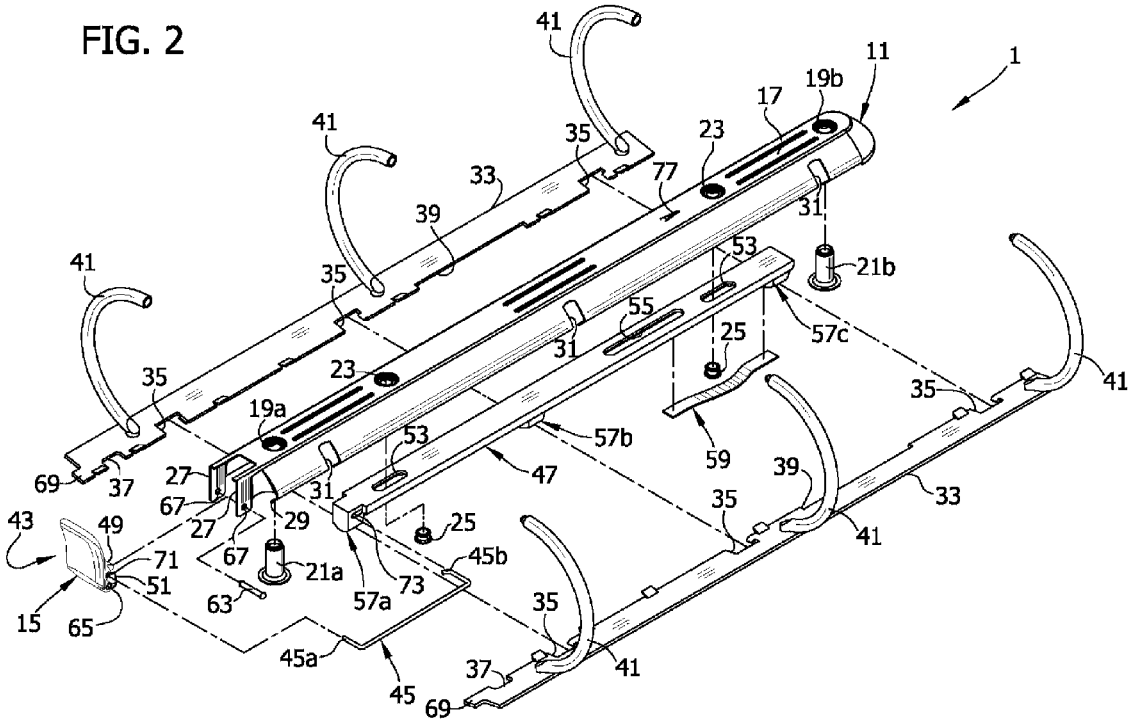
FIG. 2 is an exploded perspective of the mechanism.

Now referring to FIG. 2, housing 11 is elongate and has a uniform, generally arch-shaped elevated cross section having plateau 17 at its center. Two openings 19*a* and 19*b* are provided in the plateau for receiving and attaching first and second mounting posts 21*a* and 21*b* to secure mechanism 1 to the spine 5 of notebook 3 (FIG. 1). Additional openings 23 are provided inward from each of openings 19*a* and 19*b* and receive and attach grooved mounting rivets 25 to housing 11, the purpose for which will be explained hereinafter. The housing also has a longitudinal axis, two generally opposite longitudinal edges, and two opposite ends, a first end of which is generally open and includes tabs 27 for mounting lever 15. Bent under rims 29 are formed along the housing's longitudinal edges (the rim on only one side of mechanism 1 is visible), and six holes, each designated by reference numeral 31 (only three of which are visible), are positioned in the bent under rims to receive rings 13 through the housing 11. Mechanisms having housings of other shapes, including irregular or asymmetrical shapes, or housings that are integral with a file or notebook do not depart from the scope of this invention.

As also shown in FIG. 2, mechanism 1 includes two substantially similar hinge plates, each designated by reference numeral 33. Each hinge plate is a thin, elongate sheet having inner and outer longitudinal edge margins and two longitudinal ends. Five pairs of aligned cutouts are formed along the inner edge margins of plates 33, while the outer edge margins of the plates are free of cutouts. The cutouts of three pairs are each designated by reference numeral 35, and the cutouts of the two remaining pairs are designated by reference numerals 37 and 39 (respectively). The purpose of each pair of cutouts will be described in greater detail hereinafter.

Ring members 41 of each ring 13 are circular in cross section and are mounted on upper surfaces of hinge plates 33 in longitudinally opposed relation. They are movable conjointly with hinge plates 33 during operation between a closed position (FIGS. 1, 3, and 7A) wherein each ring member forms a continuous, closed circular loop for retaining loose-leaf pages, and an open position (FIGS. 4 and 8) wherein each ring member forms a discontinuous, open loop suitable for adding or removing pages. Ring members having different cross sections or ring members that form different shapes when closed (e.g., a D-shape) do not depart from the scope of the invention. Although both ring members 41 of each ring 13 are movable in the illustrated embodiment, a mechanism in which one ring member is movable and one is fixed does not depart from the scope of this invention (e.g., a mechanism in which one ring member of each ring is mounted on a hinge plate and one is mounted on a housing).

Figure 5:
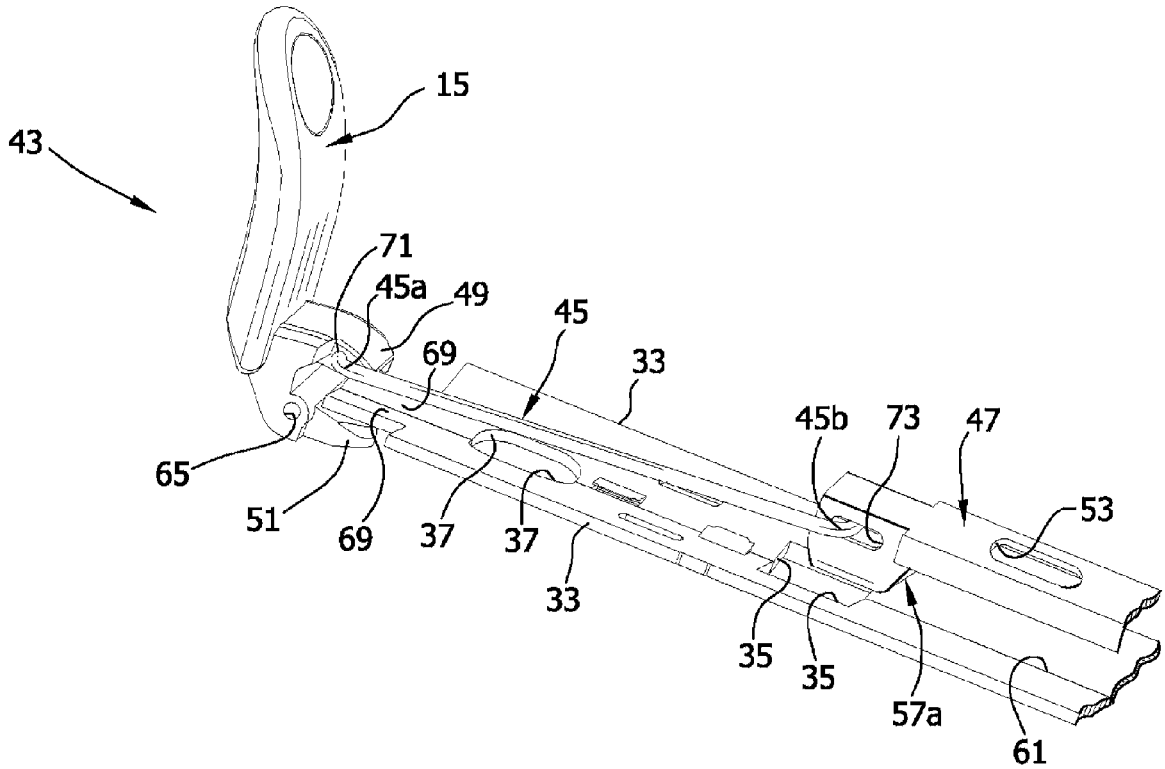
FIG. 5 is an enlarged and fragmentary perspective of a control structure of the mechanism shown in relative position with hinge plates of the mechanism when at the closed and locked position.
Figure 6:
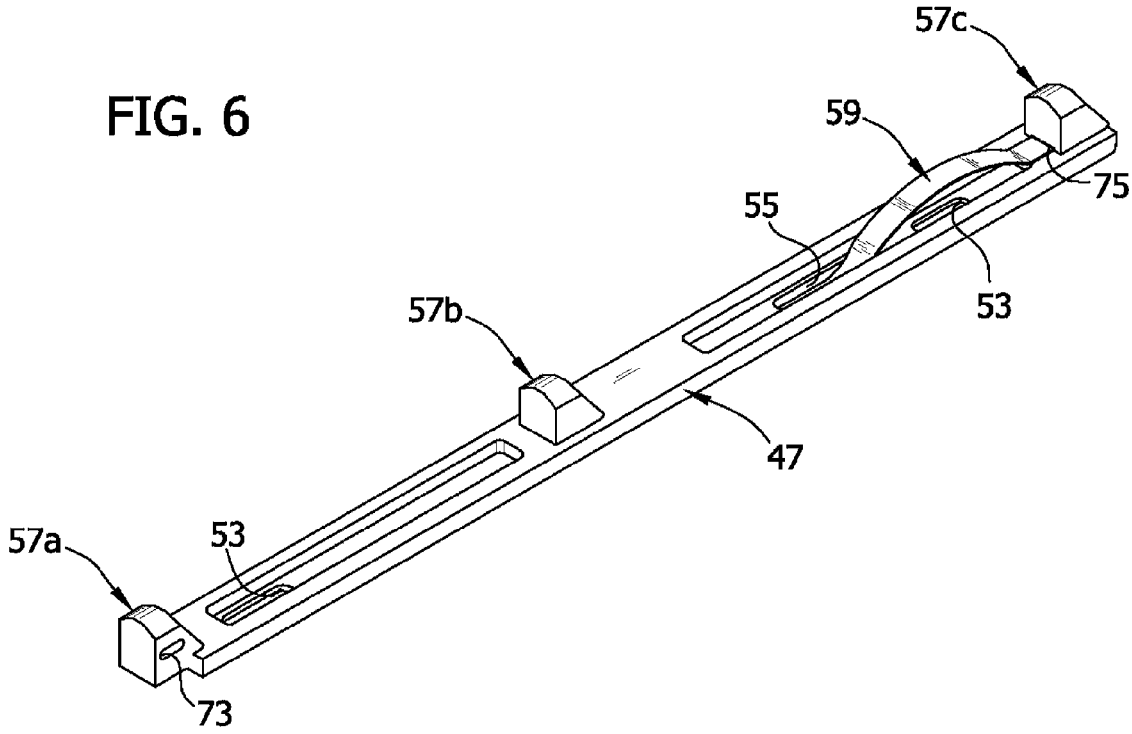
FIG. 6 is an enlarged bottom perspective of a travel bar and spring plate of the mechanism.

A control structure of mechanism 1 is indicated generally at reference numeral 43 in FIG. 2. It includes actuating lever 15, intermediate connector 45, and elongate travel bar 47, all of which are movable relative to housing 11 and each of which are designated generally by their reference numeral. Actuating lever 15 is located at the open longitudinal end of housing 11 and is bowed generally away from the housing. It includes closing arm 49 and opening arm 51 (FIG. 5) that both extend away from lever 15 and are generally vertically opposed to one another. The arms may be formed as one piece with the lever or may be formed separately and attached to the lever 15, and a mechanism having a lever shaped differently than illustrated does not depart from the scope of the invention. Intermediate connector 45 located between lever 15 and travel bar 47 connects lever 15 to travel bar 47 and in the illustrated embodiment, is a wire bent into a roughly "C" shape. End 45*a* of connector 45 is pivotally attached to lever 15, and end 45*b*, which is hook shaped, is pivotally attached to travel bar 47.

Elongate travel bar 47 extends away from intermediate connector 45 generally lengthwise of housing 11 in line with the longitudinal axis of the housing. Travel bar 47 is relatively flat and includes three elongate and oval channels. Two channels, each designated 53, are respectively located toward opposite ends of travel bar 47, and one channel 55, which is longer than each of channels 53, is located inward of one of channels 53 nearest to the travel bar end furthest from lever 15. Travel bar 47 also includes three locking elements, each designated generally by reference numerals 57*a*, 57*b*, and 57*c*, uniformly spaced along a bottom surface of the travel bar. The spacing of the locking elements corresponds to spacing between cutouts 35 of each hinge plate 33, and also closely corresponds to lateral spacing between adjacent ring members 41. In illustrated mechanism 1, locking elements 57*a*, 57*b*, and 57*c* are formed as one piece with travel bar 47. A mechanism in which locking elements are formed separately from a travel bar and then attached does not depart from the scope of the invention. Also shown in FIG. 2 is a spring plate of mechanism 1. The spring plate is designated generally by reference numeral 59 and is located adjacent travel bar 47 near the travel bar end furthest from lever 15. The spring plate 59 is generally thin and elongate in shape, and is bowed downward between its two ends. It will be described in more detail hereinafter.

Figure 3:
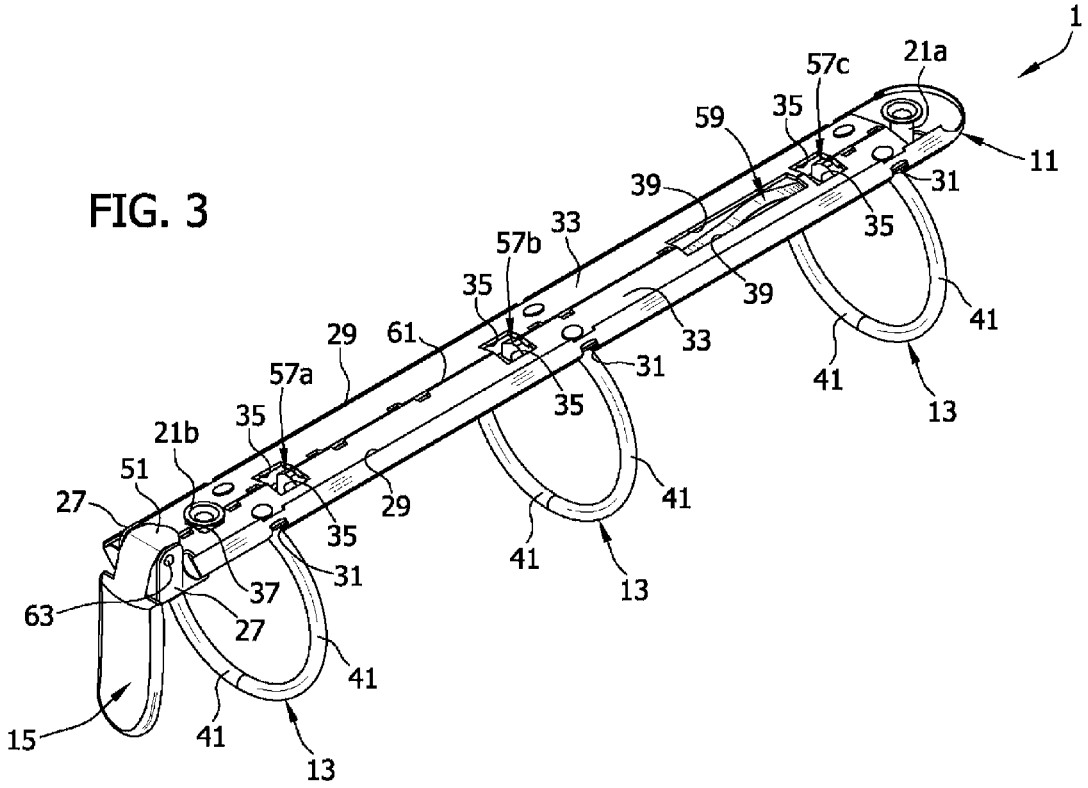
FIG. 3 is a bottom perspective of the mechanism at a closed and locked position.
Figure 4:
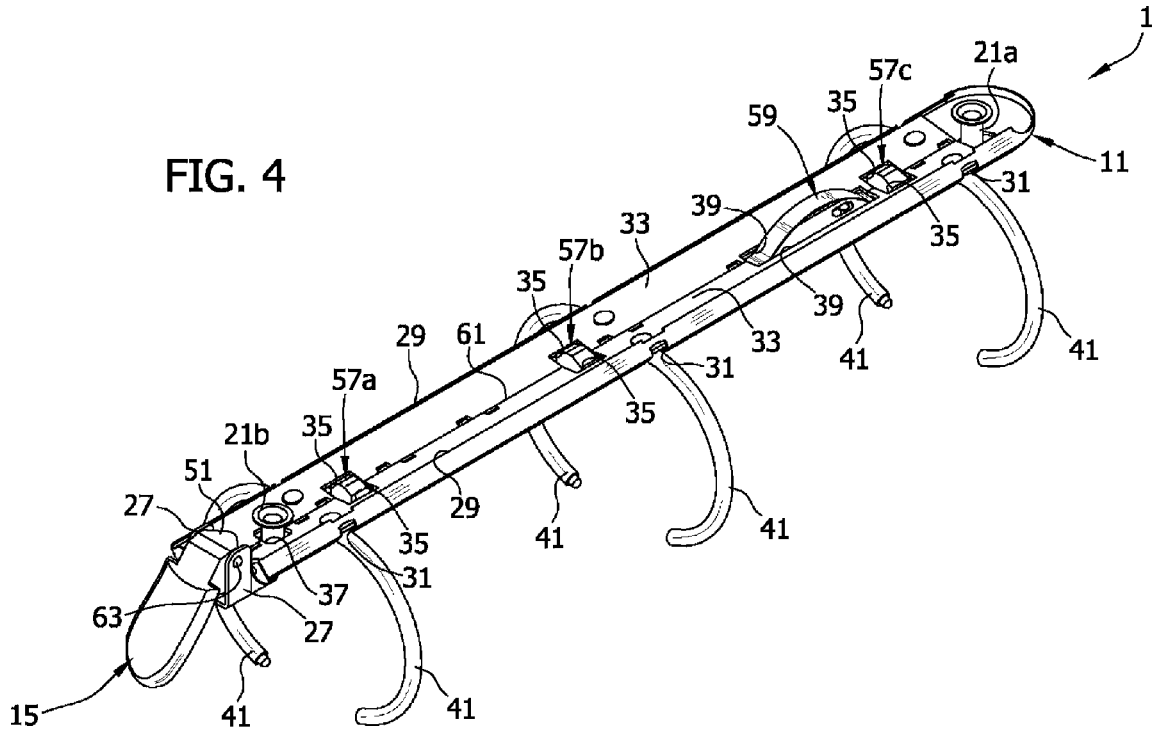
FIG. 4 is a perspective similar to FIG. 3 with the mechanism at an open position.

FIGS. 3-6 show ring binder mechanism 1 in assembled form. Referring particularly to FIGS. 3 and 4, housing 11 loosely supports hinge plates 33 in parallel arrangement such that the outer longitudinal edge margins of the hinge plates are received in corresponding bent under rims 29 of the housing. The inner longitudinal edge margins of hinge plates 33 engage each other and form hinge 61. Respective pairs of cutouts 35, 37, and 39 in the interconnected plates align to form cutout openings along hinge 61, with the hinge extending through each opening. In this plate orientation, the outer edge margins are free to move within rims 29 as plates 33 pivot about hinge 61. The hinge moves down (i.e., away from housing 11 as shown in FIG. 3) when plates 33 pivot to close ring members 41, and it moves up (i.e., toward the housing as shown in FIG. 4) when the hinge plates pivot to open the ring members. In illustrated mechanism 1, housing 11 provides a small spring force to bias hinge plates 33 to pivot away from a co-planar position of the plates (i.e., to pivot toward either the closed position or the open position). However, the biasing force provided by housing 11 is substantially smaller than in conventional ring binder mechanisms. Preferably, the housing 11 provides a force which is as small as it can be while still supporting the hinge plates.

Referring to FIGS. 2-5, lever 15 is pivotally mounted on housing 11 by hinge pin 63 through hole 65 of the lever and through hole 67 of each housing tab 27. In this position, fingers 69 of hinge plates 33 fit between closing and opening arms 49 and 51, respectively, of the lever 15, while end 45*a* of intermediate connector 45 is pivotally received in aperture 71 in the lever's closing arm 49. Hook end 45*b* of the intermediate connector pivotally and slidingly connects to travel bar 47 through elongate opening 73 in locking element 57*a*. Elongate opening 73 is sized to receive and hold hook end 45*b* during operation of mechanism 1 with some room for lateral movement of the end within the opening. It is feasible that two intermediate connectors could be employed. But it is to be understood that when one is used, it can be positioned in an opening in either side of the travel bar locking element without departing from the scope of the invention. Similarly, a mechanism having only one opening on only one side of a travel bar locking element for receiving an end of an intermediate connector does not depart from the scope of the invention.

Figure 7A:
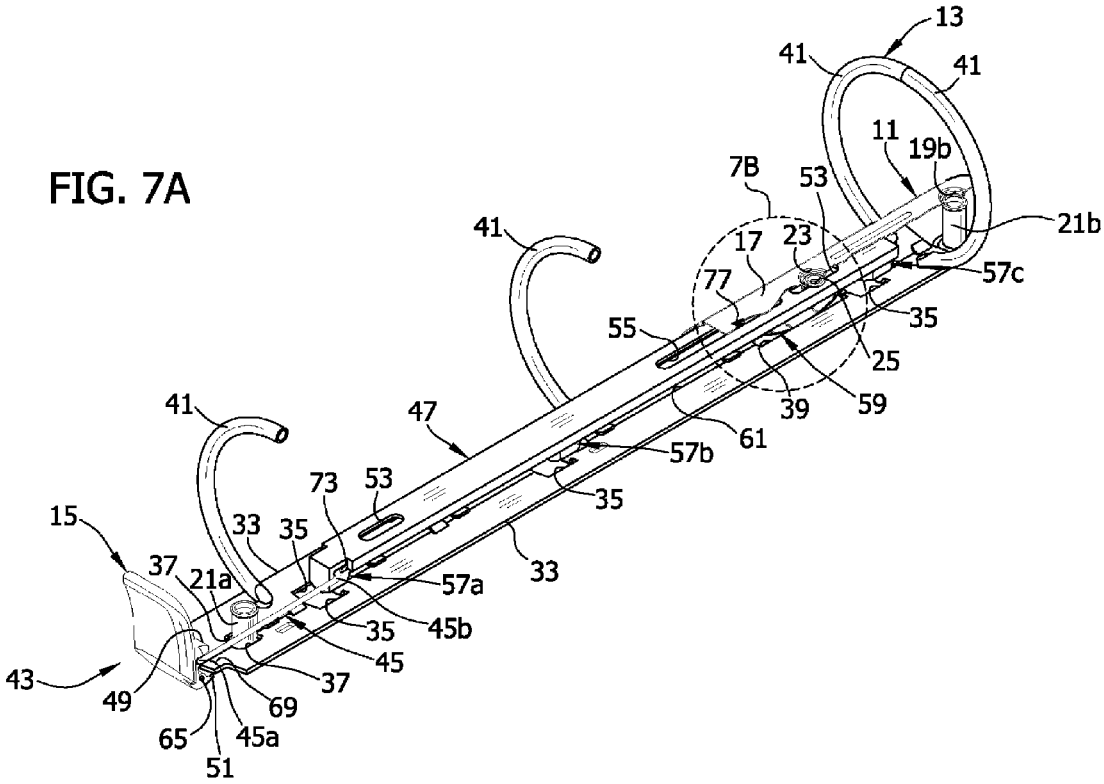
FIG. 7A is a perspective of the mechanism at the closed and locked position with a portion of a housing broken away and two ring members removed to show internal construction.
Figure 7B:
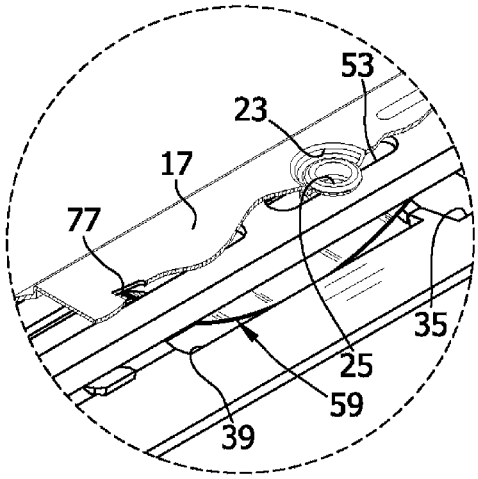
FIG. 7B is an enlarged fragmentary perspective of the mechanism of FIG. 7A illustrating orientation of the spring plate in the mechanism.
Figure 8:
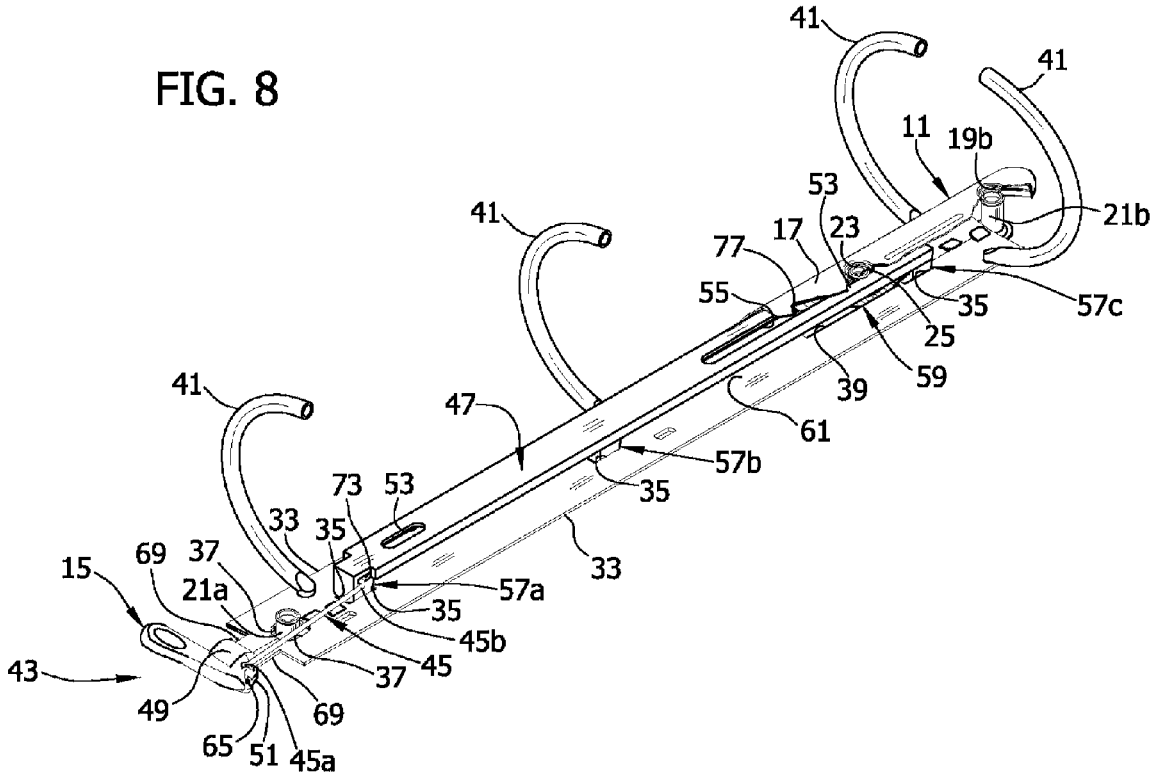
FIG. 8 is a perspective similar to FIG. 7A with the mechanism at the open position.

FIGS. 3 and 4 also show spring plate 59, which is located in general alignment with cutout opening 39 in hinge plates 33. As better shown in FIG. 6, the spring plate engages travel bar 47 at locking element 57*c*. A first end of spring plate 59 snugly fits in opening 75 in locking element 57*c* on a side of the locking element facing lever 15. The spring plate extends away from the locking element and through channel 55 in travel bar 47. A second end of the spring plate 59 is engaged with the housing between the plateau 17 at detent 77 (FIGS. 7A-8). The detent 77 is formed by bending the material of the housing 11 down from the plateau 17. Other ways of connecting the second end of the spring plate 59 to the housing 11 may be used within the scope of the present invention. As can be seen, the natural bow of spring plate 59 is downward and generally away from housing 11.

Referring now particularly to FIGS. 7A-8, and as previously alluded to, grooved mounting rivets 25 slidably connect travel bar 47 to housing 11 through outer channels 53 of the travel bar and through openings 23 of housing plateau 17. A mechanism in which a travel bar 47 is supported differently for movement relative to a housing does not depart from the scope of the invention. In this position, locking elements 57*a*, 57*b*, and 57*c* of the travel bar 47 face hinge plates 33 in general alignment with hinge 61 and at locations adjacent cutout openings 35 and ring members 41. As also shown, a first mounting post 21*a* passes through hinge plates 33 at the opening formed by cutouts 37 near lever 15 and, together with mounting post 21*b*, secures mechanism 1 to notebook 5 as shown in FIG. 1.

Operation of ring binder mechanism 1 will now be described with reference to FIGS. 3, 4, 7A, and 8. In general, control structure 43 is capable of selectively moving ring members 41 between the closed position and the open position, and of locking the closed ring members together. However, it is envisioned that a control structure could operate to lock the hinge plates without being able to cause movement of the hinge plates, or a control structure could operate to move the hinge plates between the open and closed positions without locking the hinge plates in either position. FIGS. 3 and 7A illustrate mechanism 1 in the closed and locked position. Lever 15 is in an upright position and hinge plates 33 are hinged downward and away from housing 11. Spring plate 59 is relaxed (i.e., in a less arched configuration), and locking elements 57*a*, 57*b*, and 57*c* are positioned between hinge plates 33 and travel bar 47, substantially out of registration with each corresponding cutout opening 35. Locking elements 57*a*, 57*b*, and 57*c* contact an upper surface of hinge plates 33 and, together with travel bar 47, firmly oppose any force tending to pivot the hinge plates to open ring members 41.

To unlock and open ring members 41, an operator applies force to lever 15 and begins to progressively pivot it outward and downward. This pulls intermediate connector 45 and travel bar 47 toward lever 15 (the travel bar slides longitudinally on grooved mounting rivets 25). Opening arm 51 of lever 15 engages an underside of fingers 69 of interconnected hinge plates 33, and locking elements 57*a*, 57*b*, and 57*c* move with travel bar 47 out of their locking position and toward respective cutout openings 35. The bias of the spring plate 59 positions the travel bar 47 in the first position corresponding to a closed position of the ring members 41 away from the end of the housing 11 mounting the lever 15 so that the end 45*b* of the intermediate connector 45 engages the travel bar on an end of the elongate opening 73 nearest to the lever. Thus, when the lever 15 is moved to open the ring members 41, the travel bar 47 moves immediately and prior to the opening arm 51 moving the hinge plate 33. This lost motion action allows the locking elements 57*a*, 57*b*, 57*c* to move toward registration with the openings formed by cutouts 35 before the hinge plates 33 start to pivot so that the locking elements do not impede the desirable pivoting movement of the plates. The first end of spring plate 59 moves with locking element 57*c* toward the second end of the spring plate, which is held at housing detent 77. This bows or arches spring plate 59 downward and through cutout opening 39 and stores energy in the spring plate that tends to resist further control structure movement (via travel bar 47). As the operator continues to pivot lever 15, travel bar 47 moves locking elements 57*a*, 57*b*, and 57*c* into full registration over respective cutout openings 35, and lever opening arm 51 pivots hinge plates 33 upward and through the co-planar position (overcoming the spring force of housing 11). Each cutout opening 35 passes over one of respective locking elements 57*a*, 57*b*, and 57*c*. It should be understood that if the lever is released before the ring members are open (i.e., before hinge plates 33 pivot upward through the co-planar position), spring plate 59 will automatically push travel bar 47 and locking elements 57*a*, 57*b*, and 57*c* back to the locked position, causing lever 15 to pivot back to its upright position.

FIGS. 4 and 8 show ring binder mechanism 1 in the open position. Stored energy in spring plate 59 tends to urge travel bar 47 and locking elements 57*a*, 57*b*, and 57*c* away from lever 15 and toward the locked position. This tends to pivot the lever upward and inward and moves lever closing arm 49 into engagement with an upper surface of hinge plate fingers 69. The housing spring force holds the hinge plates in their upwardly hinged position though and resists further lever movement that would pivot hinge plates 33 downward and close ring members 41. At the same time, a portion of each locking element 57*a*, 57*b*, and 57*c* frictionally engages a portion of hinge plates 33 at respective openings formed by cutouts 35, additionally holding travel bar 47 against translational movement under urge of spring plate 59. Together, these resisting features hold ring members 41 in the open position so that pages may be added to or removed from mechanism 1.

To close ring members 41 and return mechanism 1 to the locked position, the operator may either pivot lever 15 upward and inward or may manually push the ring members together. If the operator pivots lever 15, closing arm 49 engages an upper surface of each hinge plate finger 69 and pivots hinge plates 33 downward and through the co-planar position. The housing spring force moves the hinge plates 33 to their downwardly hinged position and moves cutout openings 35 over respective locking elements 57*a*, 57*b*, and 57*c*. Pivoting of the hinge plates 33 can be initiated slightly earlier than or at the same time as the movement of the travel bar 47. The end 45*b* of the intermediate connector 45 is located at the end of the elongate opening 73 nearest to the lever 15 prior to movement of the lever to close the ring members 41. When the lever 15 first begins to be pivoted up, the intermediate connector end 45*b* slides along the opening 73 so that the travel bar 47 does not move. When the end 45*b* reaches the end of the opening 73 farthest away from the lever 15, the intermediate connector 45 then begins to push the travel bar 47. In the time before the travel bar 47 begins to move, the closing arm 49 is able to engage the hinge plate 33 and start pivoting the hinge plates so that they do not block movement of the travel bar. At about the same time, spring plate 59 extends and automatically pushes travel bar 47 and its locking elements 57*a*, 57*b*, and 57*c* away from lever 15 and toward the locked position. Eventually the spring plate 59 also pulls intermediate connector 45 in a direction away from lever 15, which causes the lever to pivot to its upright position. Alternatively, if ring members 41 are manually pushed together, hinge plates 33 directly pivot downward and through the co-planar position. Each cutout opening 35 moves over respective locking element 57*a*, 57*b*, and 57*c* and lever opening arm 51 is pushed downward so that lever 15 pivots to its upright position. Spring plate 59 flattens out and again automatically pushes travel bar 47 and its locking elements 57*a*, 57*b*, and 57*c* toward the locked position blocking pivoting motion of hinge plates 33.

Ring binder mechanism 1 of the invention effectively retains loose-leaf pages when ring members 41 are closed, and readily prevents the closed ring members from unintentionally opening. Spring plate 59 is disposed to automatically position travel bar 47 and locking elements 57*a*, 57*b*, and 57*c* in the locked position when ring members 41 are closed. This eliminates additional manual movement of lever 15 to lock mechanism 1. The spring plate 59 is thin and substantially flat in the closed position and bows only a relatively small amount in the open position. Thus, the spring plate 59 requires very little space within the ring binder mechanism 1 in which to operate. This permits a low profile design of the ring binder mechanism. Also, when mechanism 1 is closed it distributes force generally uniformly to ring members 41 because locking elements 57*a*, 57*b*, and 57*c* are uniformly spaced along the length of hinge plates 33. In addition, locking elements 57*a*, 57*b*, and 57*c* are sized, along with travel bar 47, to fully occupy the area between hinge plates 33 and housing plateau 17. If the hinge plates push up on locking elements 57*a*, 57*b*, and 57*c* (i.e., such as when the hinge plates pivot to open ring members 41), they immediately engage the locking elements and force both the locking elements and travel bar 47 upward. Housing 11 resists this movement, however, and the ring members are positively locked together with gaps between the ring members minimized, if not eliminated.

Components of ring binder mechanism 1 of the invention are made of a suitable rigid material, such as a metal (e.g. steel). But mechanisms having components made of a non-metallic material, specifically including a plastic, do not depart from the scope of this invention.

When introducing elements of the invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "up" and "down" and variations of these terms is made for convenience, but does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. A ring binder mechanism for retaining loose-leaf pages, the mechanism comprising:

a housing having a detent;

hinge plates supported by the housing for pivoting motion relative to the housing, at least one of the hinge plates defining a hinge plate opening through the hinge plates;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

a control structure supported by the housing for causing the pivoting motion of the hinge plates, the control structure comprising a travel bar having an elongated travel bar opening therein, the travel bar being moveable between a first position wherein the rings are closed and locked and a second position; and a spring plate operatively connected to the control structure at a first end and received through the travel bar opening to connect to the detent in the housing at a second end, the spring plate being at least partially aligned with the opening defined by the hinge plate for passing into the opening upon deflection of the spring plate for urging the control structure from said second position toward said first position, the spring plate being located substantially below the travel bar, the travel bar opening being offset lengthwise of the housing from the hinge plate opening in the first and second positions, wherein the travel bar is slidably mounted on the housing by at least one rivet, the rivet being located directly above the spring plate.

2. A ring binder mechanism as set forth in claim 1 wherein the spring plate is generally thin and elongate.

3. A ring binder mechanism as set forth in claim 2 wherein the spring plate is arranged relative to the control structure so that movement of the control structure from said first position to said second position deflects the spring to an arched configuration and stores additional energy in the spring.

4. A ring binder mechanism as set forth in claim 3 wherein the control structure includes at least one locking element operatively connected to the spring plate, the locking element being movable between the first and second positions, in the first position the locking element locking the hinge plates in the closed position.

5. A ring binder mechanism as set forth in claim 4 wherein the at least one locking element is associated with the travel bar, the spring plate being operatively connected to the travel bar at the locking element for urging the travel bar to move the control structure toward said first position.

6. A ring binder mechanism as set forth in claim 5 wherein the first end of the spring plate moves relative to the second end when the spring plate deflects.

7. A ring binder mechanism as set forth in claim 5 wherein the travel bar includes multiple locking elements and the control structure further includes an actuating lever, the travel bar being operatively connected to the lever for moving between the first position in which the locking elements block pivoting motion of the hinge plates and the second position in which the hinge plates are free to pivot.

8. A ring binder mechanism as set forth in claim 7 wherein the hinge plates include openings for receiving the locking elements when the control structure is in said second position.

9. A ring binder mechanism as set forth in claim 7 wherein the actuating lever includes two arms for driving engagement with the hinge plates producing the pivoting motion of the hinge plates.

10. A ring binder mechanism as set forth in claim 1 wherein said hinge plate opening is defined by adjacent cutouts in the hinge plates, the pivot axis of the hinge plates extending through the opening.

11. A ring binder mechanism as set forth in claim 10 wherein the detent is struck from the housing.

12. A ring binder mechanism as set forth in claim 1 in combination with a cover, the ring binder mechanism being mounted on the cover, the cover being hinged for movement to selectively cover and expose loose-leaf pages retained on the ring binder mechanism.

13. A ring binder mechanism for retaining loose-leaf pages, the mechanism comprising:

a housing having a detent;

hinge plates supported by the housing for pivoting motion relative to the housing, at least one of the hinge plates defining an opening through the hinge plates;

rings for holding loose-leaf pages, each ring including a first ring member and a second ring member, the first ring member being mounted on a first hinge plate and moveable with the pivoting motion of the first hinge plate relative to the second ring member between a closed position and an open position, in the closed position the two ring members form a substantially continuous, closed loop for allowing loose-leaf pages retained by the rings to be moved along the rings from one ring member to the other, and in the open position the two ring members form a discontinuous, open loop for adding or removing loose-leaf pages from the rings;

an actuating lever mounted on the housing;

a travel bar operatively connected to the lever and supported by the housing for translational movement relative to the housing, the travel bar including an elongate opening therein and a locking element moveable with the travel bar between a first position blocking pivoting motion of the hinge plates and a second position; and a spring plate operatively connected to the travel bar and the detent in the housing, the spring plate being at least partially aligned with the opening defined by the hinge plate for passing into the opening upon deflection of the spring plate for urging the travel bar to move the locking element from said second position toward said first position, the spring plate being located substantially below the travel bar and received through the elongate opening therein into engagement with the housing detent;

an opening in at least one of the hinge plates positioned to receive the spring plate, and wherein the elongate opening in the travel bar and the hinge plate opening are generally offset in a direction lengthwise of the housing from each other, wherein the travel bar is slidably mounted on the housing by at least one rivet, the rivet being located directly above the spring plate.

* * * * *